United States Patent [19]

Henne et al.

[11] Patent Number: 4,905,947

[45] Date of Patent: Mar. 6, 1990

[54] DISPLAY ASSEMBLY

[75] Inventors: Daniel J. Henne, Kentwood; Steven F. Fadie, Grand Rapids; Michael C. Byers, Grand Rapids; Wayne A. Leistra, Grand Rapids; Richard H. Walcott, Grand Rapids; Jackman L. Kerwin, Jr., Stevensville, all of Mich.; Robert S. Voklert, Chicago, Ill.; Michael Briggs, Walker, Mich.

[73] Assignee: Bil Mar Foods, Inc., Zeeland, Mich.

[21] Appl. No.: 244,096

[22] Filed: Sep. 14, 1988

[51] Int. Cl.[4] ..... F16M 11/00

[52] U.S. Cl. ..... 248/174; 248/152; 206/45.19

[58] Field of Search ..... 248/174, 152, 150, 459; 211/72, 135, 132; 206/45.14, 45.19, 44 R, 562, 563; 229/16 D

[56] References Cited

U.S. PATENT DOCUMENTS

| | | | |
|---|---|---|---|
| 1,713,758 | 5/1929 | Horwath | 248/152 |
| 2,071,394 | 2/1937 | Douglas | 248/174 X |
| 2,679,971 | 6/1954 | Goldberg | 206/653 |
| 2,805,033 | 9/1957 | Rous | 248/174 |
| 3,139,255 | 6/1964 | Palm | 248/152 X |
| 3,185,292 | 5/1965 | Maro | 248/152 X |
| 3,437,193 | 4/1969 | Freeman | 248/152 X |

*Primary Examiner*—Ramon S. Britts
*Assistant Examiner*—Karen J. Chotkowski
*Attorney, Agent, or Firm*—Price, Heneveld, Cooper, De Witt & Litton

[57] ABSTRACT

A display assembly for displaying a promotional food product for consumer sampling consists of a single blank of sheet material folded into a specific configuration to define a unique, attractive and secure display structure. The single sheet of material is folded to define a base panel adapted to support the display assembly on a support surface, a front panel positioned at an inclination and having an opening for receiving a bowl or the like and a plurality of intersecting slits to form a dispensing station for napkins, an upstanding panel for providing an effective surface for supplying information regarding the offered samples, a rear surface which attaches to the rear of the upstanding panel to maintain the sheet in its folded configuration, and a pair of side panels which connect the front panel and the base panel to further enhance the structural integrity of the display assembly.

5 Claims, 1 Drawing Sheet

DISPLAY ASSEMBLY

BACKGROUND OF THE INVENTION

The present invention pertains to sampling promotion displays, and in particular to a display for promoting the sampling of food products in a market.

In food market establishments, it is often desirable to offer samples of a particular product, such as deli meats, to consumers to pique their interest and encourage sales of the product. In the past, this has been accomplished in a piecemeal fashion, with the market utilizing whatever props they had on hand. Hence, the sampling promotions have often lacked an appealing visual appearance, entailed a cumbersome and complex display setup and/or failed to adequately and favorably identify the promotional product for the consumer. These deficiencies have, in turn, lead to unsuccessful and disappointing promotions for many retailers.

SUMMARY OF THE INVENTION

The aforementioned problems and deficiencies are overcome in the present invention, wherein a sampling promotion display assembly displays the food product in an efficient, economical and attractive manner.

The present display assembly consists of a blank of sheet material which is folded into a plurality of panels. The panels are selectively joined together to form a display which not only facilitates a secure retention of the promotional samples, but also effects an attractive, sturdy, three-dimensional display which clearly identifies the product and its supplier. Moreover, the display is extremely economical to fabricate, folds flat for inexpensive and convenient shipping, and facilitates assembly in a quick and easy manner by market personnel.

These and other objects, advantages and features of the present invention will be more fully understood and appreciated by reference to the written specification and drawings.

DETAILED DESCRIPTION OF THE PREFERRED EMBODIMENTS

In the preferred embodiment, a display assembly 10 for efficiently and attractively presenting a promotional sampling display of a food product or the like includes a blank 12 capable of being folded into a unique configuration. The blank 12 consists of a relatively rigid sheet material, preferably cardboard. The blank could be of polymeric material or other known material possessing the requisite strength and aesthetic characteristics.

Figure 1:
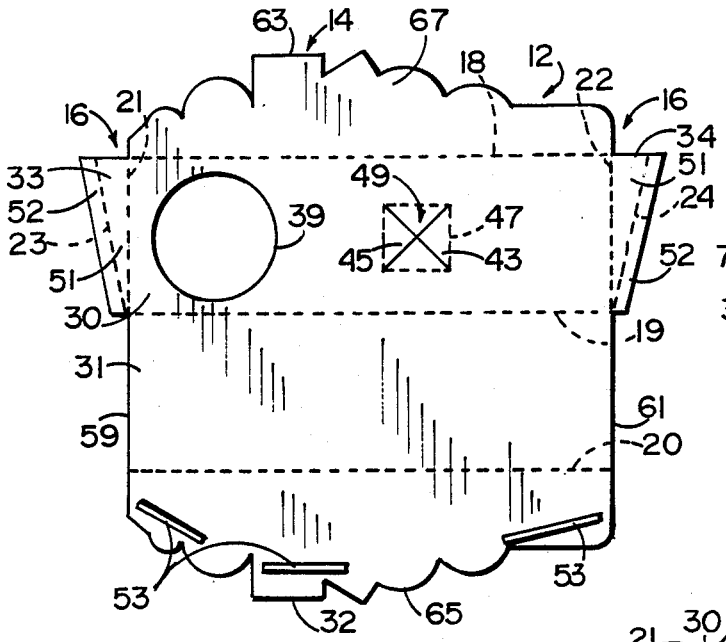
FIG. 1 is a top plan view of a blank of the present invention.

The blank 12 possesses a substantially rectangularly configured body 14 having a pair of opposed ears 16 (FIG. 1). To form the desired display, blank 12 is divided by a plurality of fold lines 18–24 to define a plurality of panels 29–34. To form the desired configuration for display purposes, panels 29–34 are folded along fold lines 18–24 and selectively joined together in a particular manner, as will be described below.

More specifically, body 14 is divided into four main panels 29–32 including a top identification panel 29, a central sample support or front panel 30, a central base panel 31 and a lower rear panel 32 (FIG. 1). Sample support panel 30 includes an opening, shown to be a circular opening 39, to facilitate the secure mounting and retention of a product container such as a bowl 41 or the like, as will be described below. Adjacent opening 39, sample support panel 30 also includes a pair of diagonal slits 43, 45 bordered by four fold lines 47 defining a substantially square configuration. This structural arrangement forms a napkin retention station 49 for sequential dispensing of napkins 50.

Figure 2:
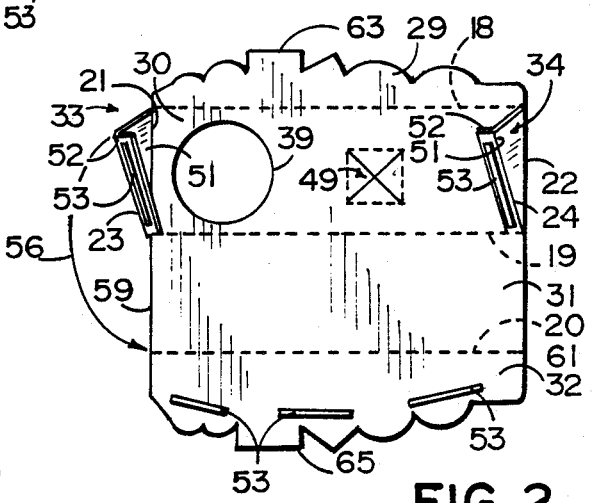
FIG. 2 is a perspective view of the blank in a first stage of assembly.
Figure 6:
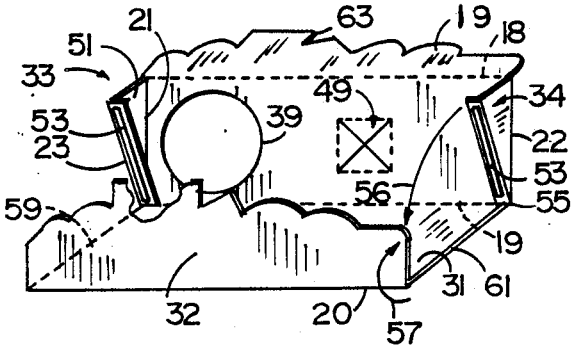
FIG. 6 is an exploded perspective view of the blank folded along the fold lines.

The oppositely projecting ears 16 define a pair of side panels 33, 34. Each side panel 33, 34 has divergent edges shown to form generally triangular shaped supports. Each is further subdivided by a fold line 23 or 24 into a main portion 51 and a generally narrow securing outer flange segment 52. As will be described further below, main portions 51 form supporting sidewalls of display 10, and securing segments 52 effect attachment of side panels 33, 34 to rear panel 31. The attachment is preferably accomplished with double-sided adhesive strips 53 (FIG. 2). Adhesive strips 53 are of a conventional design and preferably include a peel-off protective cover (not shown) to expose the adhesive only at the time of assembly. The divergent edge, triangular shape of support panels 33, 34 causes the display panel to project upwardly-rearwardly for optimum display of the product to persons in front thereof. The overall triangular configuration also provides strength to the display.

In the assembling of the display from blank 12, side panels 33, 34 are folded upwardly (as illustrated in FIG. 2) along fold lines 21, 22 so that they extend substantially at right angles to body 14. Side panels 33, 34 are further folded along fold lines 23, 24 to position securing segments 52 substantially perpendicular to main portions 51 and to overlie sample support panel 30 in a substantially parallel relationship.

In the next stage of assembly, the covers are peeled off adhesive strips 53 to expose the adhesive. Body 14 is then folded along fold line 19 such that sample support panel 30 is arcuately moved (in the direction of arrow 56) toward base panel 31 (FIG. 2). This movement continues until securing segments 52 abuttingly engage base panel 31 with adhesive strips 53 so as to be fixedly secured thereto. In this arrangement, main portions 51 of side panels 33, 34 are substantially aligned with outer edges 59, 61 of base panel 31.

Figure 3:
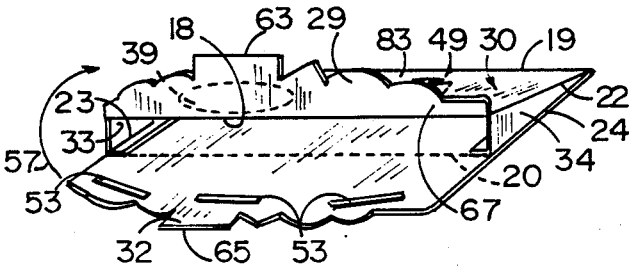
FIG. 3 is a perspective view of the blank in a final stage of assembly.

In the final stages of assembly, identification panel 29 and rear panel 32 are folded upwardly (in the direction of arrow 57) so that the top edge 63 of rear panel 32 substantially aligns with top edge 65 of identification panel 29 (FIG. 3). As seen in FIGS. 1–3, rear panel 32 also includes a plurality of adhesive strips 53 of the same type as described above for securing segments 52. These strips 53 are adapted to engage the rear surface 67 of identification panel 29 to thereby form an easily viewed upstanding panel along the rear of display 10.

Figure 4:
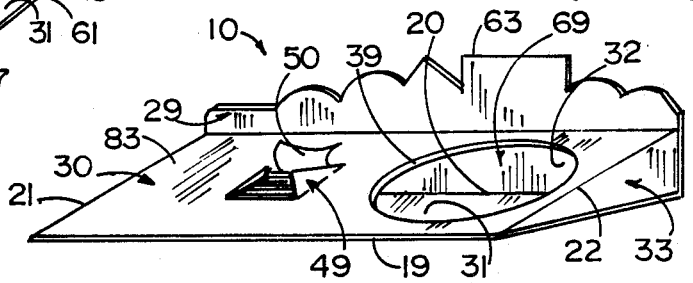
FIG. 4 is a perspective view of the assembled display.

In the assembled position (FIG. 4), the front or sample support panel 30 projects upwardly from base panel 31 at a slight inclination of approximately 15 degrees; although, this construction could include a wide range of inclinations. The inclination of sample support panel 30 fulfills a number of functions, such as providing a recess 69 having a sufficient depth below opening 39 so as to securely support and retain a sample container 41 against sliding, tipping or spilling.

Rear panel 32 and identification or upstanding panel 29 are cooperatively affixed such that identification panel 29 is held in an upstanding position, preferably at an angle of inclination on the order of 85–90 degrees. These two panels 29 and 32 are at a small acute angle to each other as assembled and are both at acute angles to panel 30. The result is a rigidifying effect adding strength to the assembly. This could be modified over a wide range of different angles. The identification panel 29 stands above the sample and provides an adequate space with which to identify not only the sample, but its corresponding supplier. The front surface 83 of identification panel 29 may also be provided with attractive illustrations of fresh food products, trademarks of the supplier, or other attractive designs which are developed to interest the consumer and present the promotional sample in a most favorable light.

Figure 5:
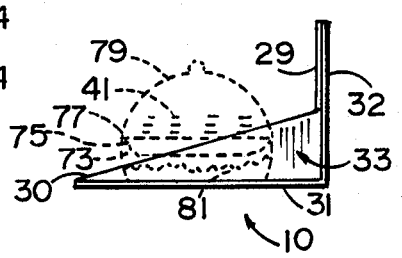
FIG. 5 is a side elevational view of the assembled display.

Bowl 41, when displaying food products, is preferably composed of a main bowl member 73, a shallow plate member 75 which rests upon a peripheral rim 77 near the top of bowl 41 and a cover 79 (FIG. 5). Typically, main bowl member 73 is filled with ice 81 and covered by shallow plate member 75. A sample promotional food product, such as deli meat, is then provided in an attractive array upon the shallow plate member 75. This array is then covered by a transparent cover 79.

In the event a transparent bowl 41 is employed, the inclination of sample support panel 30 permits the consumer to easily see not only the promotional product, but also the ice contained therebelow as an indication of the freshness of the samples during the day. Such an arrangement also enables market personnel to easily monitor the need for additional ice.

Also, the inclined sample support panel 30 provides a recess below napkin station 49 so that a number of napkins 50 may be positioned within display 10 for dispensing purposes. The receiving opening is cut in cross pattern and perforated around the periphery so that bendable tabs will move apart, and also grip the inserted napkins. By displaying the napkins 50 through the inclined surface of panel 30, they are positioned within easy viewing and reach of the consumer to further increase the attractiveness of trying the promotional product.

Of course, it is understood that the above descriptions are those of preferred embodiments of the invention. Various other embodiments as well as many changes and alterations, may be made without departing from the spirit and broader aspects of the invention as defined in the claims.

The embodiments of the invention in which an exclusive property or privilege is claimed are defined as follows.

1. A display assembly for displaying a promotional food product for consumer sampling comprising:

a base panel adapted to support the display assembly on a support surface, said base panel having a rear edge;

a front panel having a front edge and a rear edge and positioned at an inclination relative to said base panel such that said front edge forms a point with said base panel and said rear edge is positioned above said base panel, said front panel further including an opening adapted to receive and hold a bowl or the like whereby food samples may be displayed and offered to consumers and wherein said front panel defines a plurality of slits which define a station for dispensing napkins when the napkins are stored in alignment between the front panel and the base panel;

an upraised panel projecting upwardly from said rear edge of said front panel, to thereby provide an effective surface for supplying information regarding the offered samples;

side panels extending between said front panel and said base panel, said side panels including means for attachment thereof to the base panel whereby the structural integrity of the display assembly is substantially increased; and a rear panel extending from said rear edge of said base panel adjacent said upraised panel, said rear panel including means for attachment thereof to said upraised panel.

2. A blank adapted for assembly into a display comprising a single unitary sheet including:

a body divided into four panels by three substantially parallel main fold lines to thereby define two outer panels and two central panels;

a pair of ears each having a generally triangular shape and projecting laterally outward from one of said central panels, each said ears being divided from said one central panel by a side fold line, each said ear being further divided by an auxiliary fold line so that each said ear is subdivided to define a pair of ear segments, and in which one of said ear segments is of a generally triangular shape and is positioned in contiguous relation with said one central panel, and the other ear segment is of a generally parallelogram shape.

3. The blank of claim 2 in which one of said ear segments of each ear includes adhesive means for facilitating attachment thereof to the other central panel when assembled into the display.

4. The blank of claim 3 in which one of said outer panels includes adhesive means for facilitating attachment thereof to the other outer panel when assembled into the display.

5. The blank of claim 2 in which one of said central panels includes an opening for receiving and housing a structure supporting items for display.

* * * * *